United States Patent [19]

Kalkhof

[11] 4,153,031

[45] May 8, 1979

[54] APPARATUS FOR PREVENTING SPARKS IN THE IGNITION SYSTEM OF AN ENGINE WHILE THE ENGINE IS AT REST

[75] Inventor: Bernd W. Kalkhof, Reutlingen, Fed. Rep. of Germany

[73] Assignee: Robert Bosch GmbH, Stuttgart, Fed. Rep. of Germany

[21] Appl. No.: 872,880

[22] Filed: Jan. 27, 1978

[30] Foreign Application Priority Data

Feb. 11, 1977 [DE] Fed. Rep. of Germany ..... 2705715

[51] Int. Cl.[2] ..... F02P 9/00; H05B 41/14

[52] U.S. Cl. ..... 123/146.5 D; 123/148 E; 315/209 T

[58] Field of Search ..... 123/146.5 D, 148 E; 315/209 T

[56] References Cited

U.S. PATENT DOCUMENTS

| | | | |
|---|---|---|---|
| 3,745,985 | 7/1973 | Höhne | 123/148 E |
| 3,901,205 | 8/1975 | Brunsberg | 123/148 E |
| 3,949,722 | 4/1976 | Linsteadt et al. | 315/209 T |
| 4,030,469 | 6/1977 | Chateau | 123/148 E |
| 4,064,859 | 12/1977 | Kashiwazaki | 123/148 E |
| 4,077,379 | 3/1978 | Jundt et al. | 315/209 T |
| 4,084,567 | 4/1978 | Hachiga | 123/148 E |

*Primary Examiner*—Charles J. Myhre
*Assistant Examiner*—P. S. Lall
*Attorney, Agent, or Firm*—Flynn & Frishauf

[57] ABSTRACT

The voltage in the secondary of an ignition coil is prevented from reaching an amplitude at which a spark might be created by a Zener diode connected in parallel with the series transistor acting as a switch which interrupts the current through the primary winding of the coil. Upon breakdown of the Zener diode, the series transistor is switched to the conductive state briefly, thereby preventing further voltage build-up in the secondary. When the engine is in operation, a transistor which forms part of a voltage divider is switched to the conductive state, connecting the voltage divider between the secondary winding and the Zener diode. The voltage divider is so dimensioned that the Zener diode will respond to a voltage slightly less than the breakdown voltage of the emitter-collector circuit of the series transistor, but higher than the voltage required for creating a spark.

5 Claims, 2 Drawing Figures

APPARATUS FOR PREVENTING SPARKS IN THE IGNITION SYSTEM OF AN ENGINE WHILE THE ENGINE IS AT REST

The present invention relates to ignition systems for internal combustion engines. More particularly, it relates to ignition systems wherein an output switch is connected in series with a primary winding of the ignition coil and the output switch is switched to the conductive state by a pulse furnished in synchronism with the rotation of the engine. The trailing edge of the pulse times the creation of the spark. If such an engine is stopped while the output switch is in the conductive state, a current may flow through the primary winding, causing unnecessary heat losses.

BACKGROUND AND PRIOR ART.

Systems are known, for example German DT-OS 20 47 586, other prior patents: U.S. Pat. No. 3,745,985, DT-OS No. 25 25 42 677, Ser. No. 724,976 (FF 6344) wherein the current through the primary winding of the ignition coil is interrupted if the engine has been at rest for a predetermined time interval. The current in this system is interrupted by switching an output transistor connected in series with the primary winding to the nonconductive state. In such a system, the interruption of the primary current when the engine is at rest may cause a spark to be developed which, in turn, might actually cause a small explosion which might damage the engine.

THE INVENTION

It is an object of the present invention to furnish an ignition system wherein no spark can be created if the primary current through the ignition coil is interrupted while the engine is at rest.

It is a further object of the invention to furnish a spark preventing system which also serves to limit the voltage across the series switch to a value below its breakdown voltage while the engine is in operation.

SUMMARY OF THE INVENTION.

Briefly, the present invention relates to an internal combustion engine with an ignition system having a source of DC voltage, an ignition coil having a primary winding connected to said source of DC voltage and a secondary winding, spark producing means connected to said secondary winding, and output switch means, for example the base-emitter circuit of a transistor, connected in series with said primary winding and having a conductive and a nonconductive state respectively permitting and blocking current flow through said primary winding. Switching said output switch means from said conductive to said nonconductive state induces a secondary voltage across said secondary winding and a spark in said spark producing means if said secondary voltage exceeds a predetermined voltage. The ignition system further has first control means for switching said output switch means from said conductive to said nonconductive state if said output switch means is in said conductive state when said engine is at rest. The first control means, in a preferred embodiment, include a capacitor which is discharged during each rotation of the engine. When the engine is at rest, the voltage across the capacitor exceeds the threshold value of a Schmidtt trigger circuit whose output is applied to the base of the output transistor to switch it to the nonconductive state. In accordance with the invention second control means are provided which are connected to said output switch means and responsive to said secondary voltage across said secondary winding of said ignition coil, for switching said output switch means briefly back to said conductive state when said secondary voltage reaches a limiting secondary voltage less than said predetermined secondary voltage. The current flowing through said primary winding limits the voltage build-up in the secondary winding. In a preferred emodiment, a second control means comprises a Zener diode connected in parallel with the output switch means. The Zener diode is connected to the output switch means in such a way that the latter become conductive when the Zener diode breaks down. In this embodiment almost the full secondary voltage is applied to the Zener diode.

In a further preferred embodiment, a voltage divider is switched into the circuit to decrease the percentage of the secondary voltage applied to the Zener diode when the engine is operating.

Drawings, illustrating an example:

Figure 1:
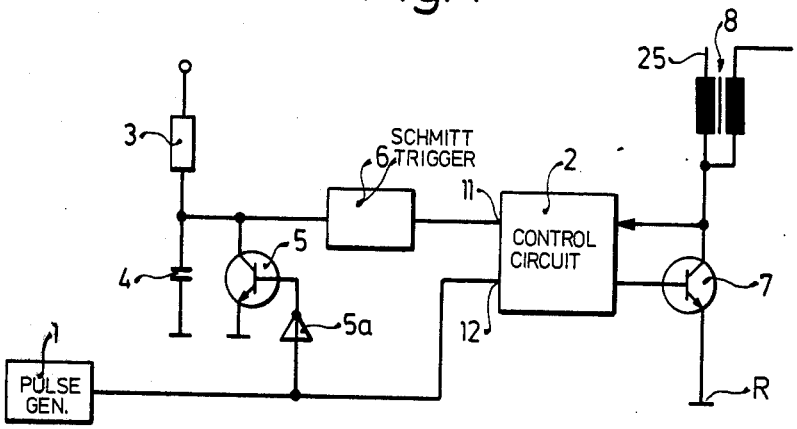
FIG. 1 is a block diagram of the system of the present invention.

In Fig. 1, an ignition pulse generator 1 is connected on the one hand to the input 12 of a control circuit 2 and, on the other hand, through an inverter 5*a* to the base of a transistor 5. The emitter-collector circuit of transistor 5 is connected in parallel with a capacitor 4 which has one terminal connected to ground potential. The other terminal of capacitor 4 is connected through a resistor 3 to the positive supply line. The common point of resistor 3 and capacitor 4 is also connected to the input of a Schmitt trigger circuit 6. The output of Schmitt trigger 6 is connected to the input 11 of control circuit 2. The output of control circuit 2 is connected to the base of output transistor 7, whose emitter-collector circuit is connected in series with the primary winding of an ignition coil 8. The other terminal of the primary winding of ignition coil 8 is connected to the positive supply line. Ignition coil 8 has a secondary winding having one terminal connected to the common point of the primary winding and the emitter-collector circuit of transistor 7 and a second terminal connected to a spark plug (not shown). The first terminal of the secondary winding of ignition coil 8 is also connected to a further input of control circuit 2.

OPERATION

Ignition pulse generator 1 is operated in synchronism with the rotation of a crankshaft of the engine. The pulses generated by pulse generator 1 switch transistor 7 to the conductive state. When transistor 7 is in the conductive state, current flows through its emitter-collector circuit and through the primary winding of ignition coil 8. Energy is thus stored in the primary winding of the ignition coil. Upon blocking of transistor 7, the stored energy causes a spark to be generated in the spark plug connected to the secondary winding. While transistor 7 is conductive, transistor 5 is blocked, causing the voltage across capacitor 4 to increase. When the pulse is terminated, that is when transistor 7 switches to the non-conductive state, transister 5 switches to the conductive state, discharging capacitor 4. Thus, while the engine is in operation, capacitor 4 is periodically discharged and the threshold voltage of Schmitt trigger 6 is not reached. The output of Schmitt trigger 6 is thus a "o" signal while the engine is operating. However, when the engine has been at rest, and particularly, when the engine has come to rest during the time a pulse is generated by pulse generator 1, the voltage across capacitor 4 increases past the threshold value of Schmitt trigger 6 and "1" signal appears at the output of the Schmitt trigger-circuit. This signal causes transistor 7 to switch to the nonconductive state, thereby interrupting the current through the primary winding of the ignition coil. This causes a rise in the voltage across the secondary winding which is applied to another input of control circuit 2. If this voltage exceeds a predetermined voltage, the control circuit acts to cause transistor 7 to become conductive for a brief time period. The resultant flow of current in the primary winding limits the voltage build-up in the secondary winding. The so-limited secondary voltage is too small to cause a spark to be generated.

Figure 2:
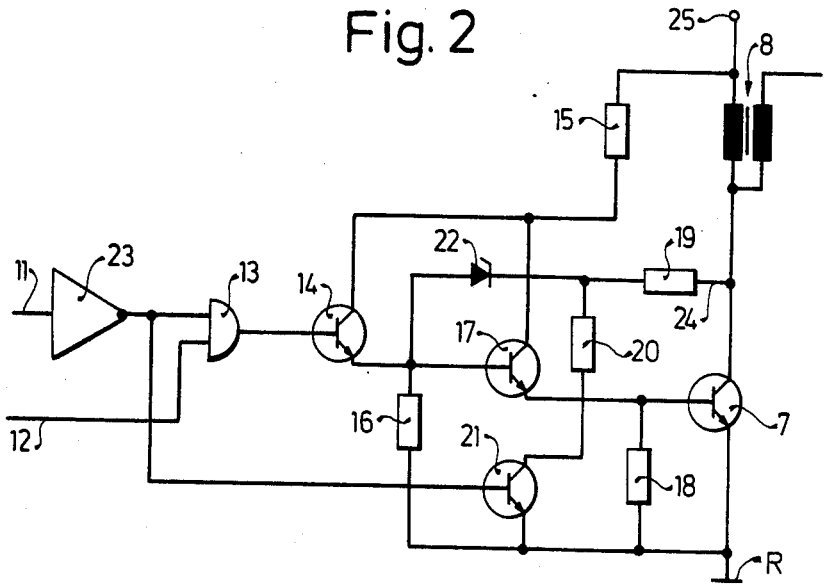
FIG. 2 is a circuit diagram of the control circuit of Fig. 1.

The control circuit shown in block form in Fig. 1 is shown in detail in Fig. 2. Input 11 of the control circuit is connected to an inverter 23 whose output is connected to one input of an AND gate 13. Input 12 of control circuit 2 is directly connected to the second input of AND gate 13. The output of AND gate 13 is connected to the base of a transistor 14. The collector of transistor 14 is connected to the voltage supply line 25 through a resistor 15. The emitter of transistor 14 is connected through a resistor 16 to ground potential and directly to the base of a transistor 17. The collector of transistor 17 is connected to the collector of transistor 14, while the emitter of transistor 17 is connected to the base of transistor 7. The emitter of transistor 17 is also connected through a resistor 18 to ground potential. The emitter of transistor 7 is also connected to ground potential, while its collector is connected through the primary winding of ignition coil 8 to the positive supply line. A line 24 is connected to the collector of transistor 7. This line is connected through a resistor 19 and a resister 20 to the collector of a transistor 21. The emitter of transistor 21 is connected to ground potential, while its base is connected to the output of inverter 23. A Zener diode 22 is interconnected between the base of transistor 17 and the common point of resistors 19 and 20.

OPERATION

While the engine is operating, pulse generator 1 furnishes a sequence of pulses which are applied to AND gate 13. Under these conditions capacitor 4 is regularly discharged, causing the output of Schmitt trigger 6 to be a "0". The second input of AND gate 13 therefore receives a steady "1" signal thereby causing transistor 14 to be switched to the conductive state. Transistors 17 and 7 are also switched to the conductive state, causing current to flow through the primary winding of coil 8. At the time of the trailing edge of the positive pulse furnished by pulse generator 1, transistors 14, 17 and 7 are switched to the nonconductive state and the voltage across the secondary winding of coil 8 increases. Since the voltage across capacitor 4 has not had a chance to rise above the threshold value of Schmitt trigger 6, the output of the latter is still "0", signal, causing a "1" signal to be applied to the base of transistor 21. This transistor is conductive. A voltage divider including resistors 19 and 20 and the emitter-collector circuit of transistor 21 is therefore connected in parallel with the emitter-collector circuit of transistor 7. The voltage applied to Zener diode 22 is thus only a fraction of the voltage appearing across the secondary winding of coil 8. When the Zener voltage across Zener diode 22 is passed, transistors 17 and 7 are switched to the conductive state. The resultant brief current flow through the primary winding limits the voltage build-up in the secondary winding to a value less than the maximum permissible voltage across the emitter-collector circuit of transistor 7. The limiting value determined by the choice of resistors 19 and 20.

When the engine is at rest, the sequence of pulses from pulse generator 1 will be interrupted. If the signal at the output of pulse generator 1 is a positive pulse at the time the engine stops, transistor 5 will be switched to the nonconductive state, causing a voltage build-up across capacitor 4. The voltage across capacitor 4 will pass the threshold value of Schmitt trigger 6, causing Schmitt trigger 6 to furnish a "1" signal. This signal, after inversion by inverter 23, blocks transistor 21. The full voltage across the secondary winding of the ignition coil, decreased only by the small voltage drop across resistor 19 due to the reverse current flowing through diode 22, is applied to diode 22. Further, the "0" signal at the output of inverter 23 blocks AND gate 13 thereby switching transistors 14, 17, and 7 to the nonconductive state. Under these conditions, the furnishing of a spark in the secondary winding of the ignition coil is to be prevented. This is accomplished as follows: a rise in the voltage across the secondary winding causes a breakdown of Zener diode 22. When Zener diode 22 becomes conductive, transistors 17 and 7 are switched to the conductive state. The latter two transistors remain conductive until Zener diode 22 again becomes nonconductive. The breakdown voltage of Zener diode 22 is so chosen that the voltage build-up in the secondary winding of the ignition coil is restricted to a value less than that required to create a spark.

It should be noted that Zener diode 22 is used to limit the voltage across the secondary winding of coil 8 both when the engine is operative and when the engine is at rest. In the former case, transistor 21 is conductive, and only a fraction of the voltage appearing across the secondary winding is applied to Zener diode 22, causing the latter to breakdown only when the voltage across the secondary winding would cause damage to transistor 7. Thus while the engine is operating, sparks can be formed in the ignition system. However, when the engine is at rest, substantially the full secondary voltage is applied to the Zener diode and the Zener diode will breakdown before the voltage across the secondary winding reaches a value sufficiently high to create a spark.

In a preferred embodiment of the present invention, the circuit, with the exception of coil 8, is embodied in an integrated circuit.

Various changes and modifications may be made within the scope of the inventive concept. In a typical example of an ignition system operating on a nominal base voltage of 12V supply between line 25 and the reference terminal R which, in an automative vehicle, would be chassis, the following values would be suitable for the control circuit:

Zener diode 22: $V_z = 21$v
Resistor 16: Λ8KΩ
Resistor 19: 27KΩ
Resistor 20: 200Ω
Transistor 7: Darlington transistor $V_{BCEO} \geqq 400$ v
Nominal breakdown voltage at the secondary of ignition coil 8 under normal operation: $V_B = 30{,}000$ V

I claim:

1. In an ignition system for internal combustion engine having a source of DC voltage an ignition coil (8) connected to said source of DC voltage, said ignition coil having a primary winding and a secondary winding, spark producing means connected to said secondary winding, output switch means (7) connected in series with said primary winding and having a conductive and a nonconductive state respectively permitting and blocking current flow through said primary winding, whereby switching said output switch means from said conductive to said nonconductive state induces a secondary voltage across said secondary winding and a spark in said spark producing means if said secondary voltage exceeds a predetermined secondary voltage, said ignition system further having first control means (3-6, 13) for switching said output switch means from said conductive to said nonconductive state if said output switch means is in said conductive state when said engine is at rest:

apparatus for preventing the furnishing of a spark while the engine is at rest, comprising, in accordance with the invention, second control means (22, 16) connected to said output switch means and responsive to said secondary voltage, for switching said output switch means briefly back to said conductive state when said secondary voltage reaches a limiting secondary voltage less than said predetermined secondary voltage, whereby current flow through said primary winding limits the voltage build-up in said secondary winding.

2. A system as set forth in claim 1, further comprising third control means (19, 20, 21) connected between said ignition coil and said second control means, and operative only in response to a first control signal, for decreasing the voltage applied to said second control means, whereby said second control means switches said output switch means to said conductive state only when said secondary voltage exceeds said predetermined secondary voltage;

and wherein said first control means comprises means for furnishing said first control signal only when said engine is in operation, whereby sparks can be created by said spark creating means during operation of said engine.

3. A system as set forth in claim 2, wherein said output switch means comprises an output transistor.

4. A system as set forth in claim 3, wherein said second control means comprises a Zener diode (22).

5. A system as set forth in claim 4, wherein said output transistor has an emitter-collector circuit connected in series with said primary winding of said ignition coil;

wherein said emitter-collector circuit has a maximum permissable breakdown voltage when said output transistor is in said nonconductive state;

and wherein said second control means switches said output transistor briefly to said conductive state when said decreased voltage is a predetermined decreased voltage corresponding to a voltage less than said predetermined breakdown voltage of said emitter-collector circuit of said output transistor.

* * * * *